US008658244B2

(12) United States Patent
Nguyen et al.

(10) Patent No.: US 8,658,244 B2
(45) Date of Patent: Feb. 25, 2014

(54) METHOD OF MAKING COLORED MULTIFILAMENT HIGH TENACITY POLYOLEFIN YARNS

(75) Inventors: Huy X. Nguyen, Miidlothian, VA (US); Thomas Y-T. Tam, Chesterfield, VA (US)

(73) Assignee: Honeywell International Inc., Morristown, NJ (US)

( * ) Notice: Subject to any disclaimer, the term of this patent is extended or adjusted under 35 U.S.C. 154(b) by 1075 days.

(21) Appl. No.: 12/215,121

(22) Filed: Jun. 25, 2008

(65) Prior Publication Data

US 2009/0324949 A1 Dec. 31, 2009

(51) Int. Cl.

| | |
|---|---|
| ***B05D 3/12*** | (2006.01) |
| ***B21F 9/00*** | (2006.01) |
| ***B05D 7/04*** | (2006.01) |
| ***D02J 1/22*** | (2006.01) |
| ***B29C 71/02*** | (2006.01) |

(52) U.S. Cl.

USPC ..... 427/175; 427/171; 427/172; 427/173; 427/541; 427/543

(58) Field of Classification Search

USPC ..... 427/171, 172, 173, 175, 434.6, 434.7, 427/434.2, 541, 542, 543, 544; 428/364, 428/365, 375, 378; 57/310, 363

See application file for complete search history.

(56) References Cited

U.S. PATENT DOCUMENTS

| | | | | | |
|---|---|---|---|---|---|
| 3,673,027 | A | * | 6/1972 | Spencer | 156/167 |
| 4,137,394 | A | | 1/1979 | Meihuizen et al. | 528/100 |
| 4,356,138 | A | | 10/1982 | Kavesh et al. | 264/164 |
| 4,403,012 | A | * | 9/1983 | Harpell et al. | 442/135 |
| 4,413,110 | A | | 11/1983 | Kavesh et al. | 526/348.1 |
| 4,422,993 | A | * | 12/1983 | Smith et al. | 264/210.8 |
| 4,430,383 | A | | 2/1984 | Smith et al. | 428/364 |
| 4,436,689 | A | | 3/1984 | Smith et al. | 264/204 |
| 4,457,985 | A | | 7/1984 | Harpell et al. | 428/224 |
| 4,536,536 | A | | 8/1985 | Kavesh et al. | 524/462 |
| 4,545,950 | A | | 10/1985 | Motooka et al. | 264/210.6 |
| 4,551,296 | A | | 11/1985 | Kavesh et al. | 264/203 |
| 4,612,148 | A | | 9/1986 | Motooka et al. | 264/49 |
| 4,617,233 | A | | 10/1986 | Ohta et al. | 428/364 |
| 4,663,101 | A | | 5/1987 | Kavesh et al. | 264/178 F |
| 5,032,338 | A | | 7/1991 | Weedon et al. | 264/203 |
| 5,246,657 | A | | 9/1993 | Yagi et al. | 264/210.6 |
| 5,286,435 | A | | 2/1994 | Slukster et al. | 264/205 |
| 5,342,567 | A | | 8/1994 | Chen et al. | 264/203 |
| 5,552,208 | A | * | 9/1996 | Lin et al. | 428/113 |
| 5,573,850 | A | * | 11/1996 | Cunningham et al. | 428/373 |
| 5,578,374 | A | | 11/1996 | Dunbar et al. | 428/364 |
| 5,702,657 | A | | 12/1997 | Yoshida et al. | 264/112 |
| 5,736,244 | A | | 4/1998 | Kavesh et al. | 428/364 |
| 5,741,451 | A | | 4/1998 | Dunbar et al. | 264/103 |
| 5,958,582 | A | | 9/1999 | Dunbar et al. | 428/364 |
| 5,972,498 | A | | 10/1999 | Kavesh et al. | 428/364 |
| 6,148,597 | A | * | 11/2000 | Cook | 57/287 |
| 6,448,359 | B1 | | 9/2002 | Kavesh | 526/352 |
| 6,969,553 | B1 | | 11/2005 | Tam et al. | 428/364 |
| 7,344,668 | B2 | | 3/2008 | Tam et al. | 264/210.8 |
| 7,370,395 | B2 | | 5/2008 | Tam | 28/246 |
| 2002/0002745 | A1 | * | 1/2002 | Crawford et al. | 8/115.6 |
| 2005/0079345 | A1 | * | 4/2005 | Thomsen et al. | 428/361 |
| 2009/0321976 | A1 | | 12/2009 | Nguyen et al. | 264/78 |

FOREIGN PATENT DOCUMENTS

| | | | |
|---|---|---|---|
| EP | 0721021 | A2 | 10/1996 |
| JP | 06-158568 | A | 6/1994 |
| JP | 2002339184 | | 11/2002 |
| JP | 2004308048 | | 11/2004 |
| WO | WO2006/040191 | | 4/2006 |
| WO | 2008141835 | A1 | 11/2008 |

* cited by examiner

*Primary Examiner* — Michael Cleveland
*Assistant Examiner* — Michael Wieczorek

(57) ABSTRACT

A method of making colored multifilament ultrahigh molecular weight polyolefin yarn, including feeding at least one substantially untwisted multifilament ultrahigh molecular weight polyolefin yarn, coating the substantially untwisted multifilament yarn with a coating composition comprising colorant in a thermoplastic resin carrier, with the coating composition being adhered to the filaments of the multifilament yarn, and heating the multifilament yarn while stretching the yarn without fusing of the filaments of the multifilament yarn. The resultant yarn is a colored multifilament yarn having improved color-fastness. The thermoplastic resin has a lower melting point than the filaments of the multifilament yarn. Preferably, a plurality of the substantially untwisted multifilament ultrahigh molecular weight polyolefin yarns are processed together. Articles formed from the colored multifilament yarns may be prepared and subjected to a heating step to provide a colored surface coating of the thermoplastic resin over the article.

24 Claims, No Drawings

METHOD OF MAKING COLORED MULTIFILAMENT HIGH TENACITY POLYOLEFIN YARNS

BACKGROUND OF THE INVENTION

1. Field of the Invention

This invention relates to improvements in multifilament yarns formed from high tenacity polyolefin fibers.

2. Description of the Related Art

It is extremely difficult to provide yarns formed from high tenacity fibers with long-lasting color. These yarns may be formed from high tenacity polyolefin fibers, such as high tenacity polyethylene fibers. These fibers are available from Honeywell International Inc. as SPECTRA® extended chain polyethylene fibers, and they are also available from other suppliers.

Typically, such high tenacity fibers are made by a spinning a solution containing polyethylene gel swelled with a suitable solvent into filaments of ultrahigh molecular weight polyethylene. The solvent is removed and the resulting yarn is stretched or drawn in one or more stages. In general, such filaments are known as "gel spun" polyolefins, with gel spun polyethylene being the most commercially sold. Solution spun polyolefin fibers are also known, as are melt extruded fibers.

Typically, the multifilament high tenacity yarns require a surface treatment step prior to applying a colorant. For example, these yarns may be treated by plasma spray or corona treated and then immediately followed with the application of a colored coating. However, such colored coating tends to come off with vigorous rubbing.

Preparation of monofilament-like fishing lines from gel spun polyethylene fibers are disclosed, for example, in U.S. Pat. No. 6,148,597 and in WO 2006/040191 A1. In these disclosures multifilament yarns are processed such that the filaments are fused together to yield a monofilament-like line.

It would be desirable to provide multifilament high tenacity yarns that have improved color-fastness.

SUMMARY OF THE INVENTION

In accordance with this invention, there is provided a method of making a colored multifilament ultrahigh molecular weight polyolefin yarn, the method comprising the steps of:

feeding at least one substantially untwisted multifilament ultrahigh molecular weight polyolefin yarn;

coating the substantially untwisted multifilament yarn with a coating composition comprising colorant in a thermoplastic resin carrier, the thermoplastic resin having a lower melting point than the filaments of the multifilament yarn, with the coating composition being adhered to the filaments of the multifilament yarn; and heating the multifilament yarn while stretching the yarn without fusing of the filaments of the multifilament yarn;

whereby a colored multifilament yarn is formed having improved color-fastness.

Also in accordance with this invention, there is provided colored ultrahigh molecular weight polyolefin multifilament yarn that has been formed by the aforementioned method.

Further in accordance with this invention there is provided a method of making a colored multifilament ultrahigh molecular weight polyolefin yarn, the method comprising the steps of:

feeding a plurality of substantially untwisted multifilament ultrahigh molecular weight polyolefin yarns;

coating the substantially untwisted multifilament yarns with a coating composition comprising colorant in a thermoplastic resin carrier, the thermoplastic resin having a lower melting point than the filaments of the multifilament yarns, with the coating composition being adhered to the filaments of the multifilament yarn; and heating the multifilament yarns while stretching the yarn without fusing of the filaments of the multifilament yarn;

whereby a colored multifilament yarn is formed having improved color-fastness.

In further accordance with this invention there is provided a method of making a colored article, the method comprising the steps of:

feeding at least one substantially untwisted multifilament ultrahigh molecular weight polyolefin yarn;

coating the substantially untwisted multifilament yarn with a coating composition comprising colorant in a thermoplastic resin carrier, the thermoplastic resin having a lower melting point than the filaments of the multifilament yarn, with the coating composition being adhered to the filaments of the multifilament yarn;

heating the multifilament yarn while stretching the yarn without fusing of the filaments of the multifilament yarn to thereby form a colored multifilament yarn improved color-fastness;

forming an article from the colored multifilament yarn; and heating said article whereby the thermoplastic resin is at least softened so as to form a colored surface coating on the article.

Preferably, the feeder yarn used in the above method is a relatively low tenacity, heavy denier yarn. Also, preferably the multifilament yarn is substantially untwisted as it is heated and stretched. Preferably, the polyolefin yarn comprises a high tenacity polyethylene yarn.

This invention thus provides colored multifilament yarn from ultrahigh molecular weight polyolefins with improved color-fastness. This is achieved without the need for a costly pretreatment step (such as corona treatment) on the multifilament yarn. The resultant multifilament yarns may be used in a variety of applications, such as in ropes and in other high demanding applications, such as storm curtains, reinforcement hose, etc.

DETAILED DESCRIPTION OF THE INVENTION

The multifilament yarns used herein are high tenacity polyolefin filaments. As used herein, the term "high tenacity" fibers or filaments means fibers or filaments which have tenacities equal to or greater than about 7 g/d. Preferably, these fibers have initial tensile moduli of at least about 150 g/d and energies-to-break of at least about 8 J/g as measured by ASTM D2256. As used herein, the terms "initial tensile modulus", "tensile modulus" and "modulus" mean the modulus of elasticity as measured by ASTM 2256 for a yarn.

For the purposes of the present invention, a filament is an elongate body the length dimension of which is much greater that the transverse dimensions of width and thickness. Accordingly, the term filament includes fiber, ribbon, strip, staple and other forms of chopped, cut or discontinuous fiber or continuous fiber. The term "fiber" or "filament" includes a plurality of any of the foregoing or a combination thereof. A yarn is a continuous strand comprised of many fibers or filaments. Preferred are continuous multifilament yarns.

Preferably, the high tenacity fibers have tenacities equal to or greater than about 10 g/d, more preferably equal to or greater than about 15 g/d, even more preferably equal to or greater than about 20 g/d, and most preferably equal to or greater than about 25 g/d.

The fibers utilized in the multifilament yarns of this invention comprise extended chain (also known as ultrahigh molecular weight or high modulus) polyolefin fibers, particularly high tenacity polyethylene fibers and polypropylene fibers, and blends thereof. The fibers may be gel-spun, solution-spun or extruded.

The cross-sections of fibers useful herein may vary widely. They may be circular, flat or oblong in cross-section. They may also be of irregular or regular multi-lobal cross-section having one or more regular or irregular lobes projecting from the linear or longitudinal axis of the fibers. It is preferred that the fibers be of substantially circular, flat or oblong cross-section, most preferably substantially circular cross-section.

U.S. Pat. No. 4,457,985 generally discusses such high molecular weight polyethylene and polypropylene fibers, and the disclosure of this patent is hereby incorporated by reference to the extent that it is not inconsistent herewith. In the case of polyethylene, suitable fibers are those of weight average molecular weight of at least about 150,000, preferably at least about one million and more preferably between about two million and about five million. Such high molecular weight polyethylene fibers may be spun in solution (see U.S. Pat. Nos. 4,137,394 and 4,356,138), or a filament spun from a solution to form a gel structure (see U.S. Pat. No. 4,413,110, German Off. No. 3,004,699 and GB Patent 2051667), or the polyethylene fibers may be produced by a rolling and drawing process (see U.S. Pat. No. 5,702,657). As used herein, the term polyethylene means a predominantly linear polyethylene material that may contain minor amounts of chain branching or comonomers not exceeding about 5 modifying units per 100 main chain carbon atoms, and that may also contain admixed therewith not more than about 50 wt % of one or more polymeric additives such as alkene-l-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as antioxidants, lubricants, ultraviolet screening agents, and the like which are commonly incorporated.

High tenacity polyethylene multifilament yarns are preferred, and these are available, for example, under the trademark SPECTRA® fibers and yarns from Honeywell International Inc. of Morristown, N.J., U.S.A Depending upon the formation technique, the draw ratio and temperatures, and other conditions, a variety of properties can be imparted to these precursor fibers. The tenacity of the polyethylene fibers are at least about 7 g/d, preferably at least about 15 g/d, more preferably at least about 20 g/d, still more preferably at least about 25 g/d and most preferably at least about 30 g/d. Similarly, the initial tensile modulus of the fibers, as measured by an Instron tensile testing machine, is preferably at least about 300 g/d, more preferably at least about 500 g/d, still more preferably at least about 1,000 g/d and most preferably at least about 1,200 g/d. These highest values for initial tensile modulus and tenacity are generally obtainable only by employing solution grown or gel spinning processes. Many of the filaments have melting points higher than the melting point of the polymer from which they were formed. Thus, for example, high molecular weight polyethylene of about 150,000, about one million and about two million molecular weight generally have melting points in the bulk of 138° C. The highly oriented polyethylene filaments made of these materials have melting points of from about 7° C. to about 13° C. higher. Thus, a slight increase in melting point reflects the crystalline perfection and higher crystalline orientation of the filaments as compared to the bulk polymer.

Preferably the polyethylene employed is a polyethylene having fewer than about one methyl group per thousand carbon atoms, more preferably fewer than about 0.5 methyl groups per thousand carbon atoms, and less than about 1 wt. % of other constituents.

Similarly, highly oriented high molecular weight polypropylene fibers of weight average molecular weight at least about 200,000, preferably at least about one million and more preferably at least about two million may be used. Such extended chain polypropylene may be formed into reasonably well oriented filaments by the techniques prescribed in the various references referred to above, and especially by the technique of U.S. Pat. No. 4,413,110. Since polypropylene is a much less crystalline material than polyethylene and contains pendant methyl groups, tenacity values achievable with polypropylene are generally substantially lower than the corresponding values for polyethylene. Accordingly, a suitable tenacity is preferably at least about 8 g/d, more preferably at least about 11 g/d. The initial tensile modulus for polypropylene is preferably at least about 160 g/d, more preferably at least about 200 g/d. The melting point of the polypropylene is generally raised several degrees by the orientation process, such that the polypropylene filament preferably has a main melting point of at least 168° C., more preferably at least 170° C. The particularly preferred ranges for the above described parameters can advantageously provide improved performance in the final article. Employing fibers having a weight average molecular weight of at least about 200,000 coupled with the preferred ranges for the above-described parameters (modulus and tenacity) can provide advantageously improved performance in the final article.

In the case of extended chain polyethylene fibers, preparation and drawing of gel-spun polyethylene fibers are described in various publications, including U.S. Pat. Nos. 4,413,110; 4,430,383; 4,436,689; 4,536,536; 4,545,950; 4,551,296; 4,612,148; 4,617,233; 4,663,101; 5,032,338; 5,246,657; 5,286,435; 5,342,567; 5,578,374; 5,736,244; 5,741,451; 5,958,582; 5,972,498; 6,448,359; 6,969,553 and 7,344,668, the disclosures of which are expressly incorporated herein by reference to the extent not incompatible herewith.

The multifilament yarns of this invention comprise the high tenacity polyolefin fibers, or consist essentially of the high tenacity polyolefin fibers, or consist of the high tenacity polyolefin fibers, and the polyolefin fibers preferably are high tenacity polyethylene fibers. The multifilament yarns may be formed by any suitable technique, including melt extrusion. The multifilament yarns may be aligned in a substantially uniaxial direction along the length of the yarn. By "substantially uniaxial direction" is meant that all or almost all (for example, at least about 95%, more preferably at least about 99%) of the yarns extend in a single direction. The multifilament feeder yarns are substantially untwisted. By "substantially untwisted" means that the yarns have zero twist or very little twist along their length (for example, no more than about 0.1 turns per inch (4 turns per meter), preferably no more than about 0.05 turns per inch (2 turns per meter) along the length of the yarn).

The yarns of the high tenacity fibers used herein may be of any suitable denier, such as, for example, about 100 to about 10,000 denier, more preferably from about 1000 to about 8,000 denier, still more preferably from about 650 to about 6000 denier, and most preferably from about 1200 to about 4800 denier.

The number of filaments forming the multifilament feeder yarns used in this invention may vary widely depending on the desired properties. For example, the number of filaments in a yarn may range from about 10 to about 3000, more preferably from about 30 to about 1500, and most preferably from about 60 to about 1200. Although not required, the number of filaments in each multifilament precursor yarn preferably is substantially the same.

In accordance with this invention, the multifilament yarns are coated with a colorant. Any suitable coating technique may be employed. Examples of coating apparatus that are useful in the method of this invention include, without limitation: lube rolls, kiss rolls, dip baths, spray coaters, etc. Alternatively, extrusion coaters may be employed. The colorant is supplied in a carrier and may be in the form of a solution, dispersion or an emulsion using any suitable solvent, such as water or an organic solvent (such as methyl ethyl ketone, acetone, ethanol, methanol, isopropyl alcohol, cyclohexane, ethyl acetone, etc. and combinations thereof). The colorant is preferably applied as a continuous coating, although a discontinuous coating may be employed if desired.

In one preferred embodiment the yarns are dipped into a bath containing the colorant coating composition. Following coating by any technique, excess coating composition may be removed by any one or more suitable means, such as being squeezed out, blown off or drained off, or air dried or dried in a heating device.

As the colorant, any suitable coloring agent may be employed. Examples are dyes and pigments, both aqueous and organic. Non-limiting examples of such colorants are copper phthalocyanine and the like. Any desirable color can be achieved with the appropriate selection of dyes or pigments and coating resin.

The colorant composition comprises the colorant and a thermoplastic resin carrier material. The thermoplastic resin has a lower melting point than that of the fibers of the multifilament yarn. The thermoplastic resin is also selected to have good adhesion or affinity to the filaments of the multifilament yarn. The resin is also a drawable material. The coating composition may include conventional additives such as UV stabilizers, etc.

Examples of such thermoplastic resins include, without limitation, polyolefin resins such as low density polyethylene, linear low density polyethylene, polyolefin copolymers, e.g., ethylene copolymers such as ethylene-acrylic acid copolymer, ethylene-ethyl acrylate copolymer, ethylene-vinyl acetate copolymer, and the like, and blends of one or more of the foregoing. Non-limiting examples of other thermoplastic resins include: polybutadiene, polyisoprene, natural rubber, ethylene-propylene copolymers, ethylene-propylene-diene terpolymers, polyurethanes, polyurethane elastomers, chlorosulfonated polyethylene, polychloroprene, plasticized polyvinylchloride using dioctyl phthalate or other plasticizers, butadiene acrylonitrile elastomers, poly(isobutylene-co-isoprene), tri-block copolymers of styrene-isoprene-styrene, polyacrylates, fluoroelastomers, silicone elastomers, thermoplastic elastomers, block copolymers of poly(isoprene), block copolymers of conjugated dienes (such as butadiene and isoprene) and vinyl aromatic copolymers (such as styrene, vinyl toluene and t-butyl styrene), tri-block copolymers of styrene-isoprene-styrene, etc.

The amount of the colored coating on the yarns may vary widely. For example, the coating may comprise from about 1 to about 40 percent by weight of the total weight of the yarns after drying, more preferably from about 2 to about 25 percent by weight, and most preferably from about 5 to about 15 percent by weight. Of course, the weight of the colorant in the coating material may be significantly less than the weight of the colored coating. Typically, the amount of colorant in the colored coating may range from about 0.5 to about 20 weight percent, more preferably from about 2 to about 15 weight percent, and most preferably from about 4 to about 10 weight percent.

The color coated multifilament yarns are preferably dried before further processing. The yarns may be heated in a suitable device (oven or the like) or air dried to remove the coating solvent or otherwise dry the colored coating. The color coated multifilament yarns may then be taken up for further processing, or the yarn can be continuously processed.

The colored coated multifilament yarns are then subjected to a drawing step at an elevated temperature. The drawing step may be a single drawing step or multiple drawing steps. Preferably, the yarns are drawn in a hot air oven, although other types of ovens may be employed. Such hot air ovens are known in the art, and an example of such an oven is described in U.S. Pat. No. 7,370,395, the disclosure of which is hereby incorporated by reference to the extent that it is not inconsistent herewith.

The coated multifilament yarns are preferably fed to the drawing step without twisting of the yarns. That is, the yarns entering the drawing step preferably remain substantially untwisted.

The temperature of the drawing oven may vary depending upon the end use properties of the multifilament yarn. In any case, the temperature is chosen to avoid fusing adjacent filaments of the multifilament yarn.

The drawing temperature and draw ratios are chosen depending upon the desired end use properties. For example, in one embodiment the method of this invention may be employed to form a colored multifilament yarn that has the same or only a small increase in the yarn tenacity of the yarn, but nevertheless exhibits the desired color-fastness. In another embodiment, the method of the invention may be employed to form a color-fast multifilament yarn that also has a larger increase in the yarn tenacity.

In general, the temperature of the oven may range from about 90 to about 160° C. Where an increase in color-fastness is desired but not necessarily an increase in the yarn tenacity, the temperature of the oven can be relatively lower to a level than only softens or melts the lower melting point thermoplastic resin. In such case, the temperature of the oven may range from about 90 to about 120° C., more preferably from about 100 to 120° C., and most preferably from about 105 to about 110° C.

Where both an increase in color-fastness and tenacity is desired, the temperature of the oven can be relatively higher. For example, the temperature of the oven may range from about 135 to about 160° C., more preferably from about 145 to about 157° C., and most preferably from about 150 to about 155° C. Again, fusion of the multifilaments is not desired so that the temperature, draw ratio and residence time are selected to maintain the multifilament nature of the yarn.

Drawing is desirably achieved by one or more stretch rollers that desirably may be outside of the ovens, or alternatively inside or between one or more ovens.

As mentioned above, during the heating step the multifilament yarns are drawn (or stretched) to a desired degree. Any desired stretch ratio may be employed. In general, the draw ratios may range from about 1.1 to about 10. Where only color-fastness is desired, lower draw ratios may be employed, such as from about 1.1 to about 1.8, more preferably from about 1.2 to about 1.6, and most preferably from about 1.3 to about 1.5. Where both color-fastness and increased tenacity are desired, higher draw ratios may be used, such as from about 2 to about 10, more preferably from about 3 to about 8, and most preferably from about 4 to about 6. Desirably, line tension is applied throughout the drawing step.

The yarns are heated and drawn for a desired period of time. This may range, for example, from about 0.3 to about 5 minutes, more preferably from about 0.5 to about 3 minutes, and most preferably from about 0.8 to about 2 minutes. The actual dwell time in a heating apparatus such as an oven depends on several factors, such as the temperature of the oven, the length of the oven, the type of oven (e.g., hot air circulating oven, heated bath, infrared oven, etc.), etc.

The conditions of heating and drawing are chosen such that the adjacent filaments are not fused together, either partially or fully. This is to ensure that the resulting yarn retains its multifilament characteristics. The resulting multifilament yarn either has a similar denier and tenacity as the feeder yarn, or depending on the conditions employed it may also have a lower denier and a higher tenacity than the feeder yarn.

During the drawing step under elevated temperatures, the colored coating penetrates the polyolefin fiber and thus becomes an integral part thereof. That is, the lower melting point thermoplastic resin carrier can penetrate into the higher melting point polyolefin yarn and bring with it the desired color property. It is believed that the heating and drawing process softens both the coating resin and the fiber, allowing the lower molecular weight coating to migrate into the fiber bulk.

The resulting multifilament yarn may be of any suitable denier. For example, the multifilament yarn may have a denier of from about 50 to about 10,000, more preferably from about 200 to about 5,000, and most preferably from about 500 to about 3,000. The tenacity of the resulting multifilament yarn may range from about 25 to about 80 g/d, for example.

Surprisingly, it has been found that when the multifilament yarns are treated with a colorant composition comprising a colorant and a thermoplastic resin carrier and then subjected to drawing at elevated temperatures, the resulting multifilament yarn exhibits increased color-fastness. By this is meant that the color is retained in the yarn even after vigorous rubbing. Desirably as mentioned above, the yarn remains substantially untwisted throughout the coating and heating/drawing operations.

The colored multifilament yarns of the invention may be employed in a variety of applications. Non-limiting examples of such applications include ropes, fishing line, braided ropes and lines, kite lines, woven fabrics, knitted gloves, etc. In certain cases it may be desired to further process articles formed from the colored multifilament yarns of this invention in order to take advantage of the lower melting point nature of the thermoplastic resin coating. For example, woven fabrics may be formed from the multifilament yarns of the invention and afterwards the fabric may be subjected to a calendering step. In the calendering step both pressure and heat are applied to the fabric, with the result that the thermoplastic resin is at least softened or may be melted and forms a film-like structure over the woven fabric. This film-like structure also has the colorant that was used in forming the colored multifilament yarn, such that a color coated fabric having a layer of colored thermoplastic resin on its surface is obtained.

Similarly, when ropes are formed from the colored multifilament yarns of the invention they likewise may be subjected to another heating step. This latter step results in softening or melting of the thermoplastic resin such that a colored protective jacket is formed over the rope structure. Likewise, a fishing line (whether braided or twisted or not) formed from the multifilament yarn of the invention may be heated so as to form a line with an outer colored jacket in which the multifilament yarns may be partially fused together.

The conditions employed in any heating step applied to articles formed from the colored multifilament yarn depends upon the type of final article and its desired properties. In general, temperatures in the range mentioned above where only color-fastness is desired may be employed in such subsequent heating step.

The following non-limiting examples are presented to provide a more complete understanding of the invention. The specific techniques, conditions, materials, proportions and reported data set forth to illustrate the principles of the invention are exemplary and should not be construed as limiting the scope of the invention.

EXAMPLES

Example 1

A multifilament colored coated yarn was formed from a multifilament extended chain polyethylene yarn. Each yarn was formed from SPECTRA® 900 fibers, available from Honeywell International Inc. The uncoated feeder yarns had a denier of 1200, with 120 filaments in each yarn. The feeder yarn tenacity was 30 g/d, and had an ultimate elongation of 3.9% and a modulus of 850 g/d. Multifilament yarns having essentially zero twist were fed into a coating bath containing an aqueous solution of green dye pigment, based on copper phthalocyanine, dispersed in a polyethylene thermoplastic resin. The solids content of the coating solution was about 40 weight percent. The pick up weight of the coating onto the yarn was about 15 percent, based on the total weight of the multifilament yarns. The yarn was dried in a hot air oven. After this coating process, each coated yarn had a denier of 1369, with 120 filaments in each yarn. This yarn had an ultimate elongation of 4.38%, a tenacity of 27.6 g/d and a modulus of 775 g/d.

The colored coated yarns were fed into a heating apparatus as disclosed in the aforementioned U.S. Pat. No. 7,370,395, using a total of 6 horizontally aligned and abutting hot air circulating ovens. A first set of rolls was adjacent the inlet side of the ovens and a second set of rolls was adjacent the outlet side of the ovens. The yarns were unsupported in the ovens and were transported through the ovens in an approximate straight line. The speeds of the first and second set of rolls were selected to provide a draw ratio in the ovens of 3.0, with the feed roll speed being 10 M/min and the draw roll speed being 30 M/m. A tension of 1700 g was maintained on the yarns. The oven temperature was 150° C. The multifilament yarns were drawn, but not fused in the ovens. The resulting multifilament yarn was wound up on a take off roll.

The coated and drawn multifilament yarn had a denier of 488, an ultimate elongation of 3.2%, a tenacity of 37.2 g/d and a modulus of 1411 g/d.

The color-fastness of the multifilament yarn was tested by abrading it against a metal bar with hexagonal cross-section (the Hex Bar abrasion resistance test). The yarn was found to maintain its original green color after 2,500 cycles under a tension of 100 g.

Example 2

Example 1 was repeated except that the feeder yarn is a SPECTRA® 900, 650 denier yarn. The feeder yarn had 60 filaments, a tenacity of 30.5 g/d, an ultimate elongation of 3.6% and a modulus of 920 g/d. After the coating process, each coated yarn had a denier of 792, with 60 filaments in each yarn. This yarn had an ultimate elongation of 4.3%, a tenacity of 27.1 g/d and a modulus of 772 g/d.

The multifilament yarn after heating and drawing had 60 filaments, a denier of 249, an ultimate elongation of 2.7%, a tenacity of 35.2 g/d and a modulus of 1422 g/d. A tension of 850 g was maintained on the yarns.

The multifilament yarn was tested for its color-fastness by abrading it in the Hex Bar abrasion resistance test. The multifilament yarn was found to maintain its original color after 2,500 abrading cycles under a tension of 50 g.

As can be seen from Examples 1 and 2, the method of this invention provides colored multifilament yarn that has excellent color-fastness. The multifilament yarn also has improved tenacity when compared with the feeder yarn.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A method of making a colored color-fast multifilament ultrahigh molecular weight polyolefin yarn, the method comprising the steps of:

feeding at least one substantially untwisted multifilament ultrahigh molecular weight polyolefin yarn, each yarn being aligned in a substantially uniaxial direction;

coating the individual filaments of said substantially untwisted, substantially uniaxial aligned multifilament yarn with a coating composition comprising colorant in a thermoplastic resin carrier, wherein said coating composition comprises a solvent; said thermoplastic resin having a lower melting point than the filaments of said multifilament yarn, with said coating composition being adhered to the filaments of said multifilament yarn; and heating the multifilament yarn while stretching the yarn without fusing of the filaments of the multifilament yarn;

whereby a colored color-fast multifilament yarn that retains its multifilament characteristics is formed, wherein adjacent filaments are not fused together either partially or fully, and having individual filaments colored by said colorant with the color becoming an integral part of said filaments of said multifilament yarn.

2. The method of claim 1 wherein said multifilament yarn comprises high tenacity polyethylene filaments.

3. The method of claim 2 wherein said multifilament yam prior to coating has a denier of from about 100 to about 10,000.

4. The method of claim 1 wherein said thermoplastic resin comprises a polyolefin resin.

5. The method of claim 4 wherein said thermoplastic resin comprises a polyolefin copolymer.

6. The method of claim 1 wherein said multifilament yarns are substantially untwisted prior to said heating and stretching step.

7. The method of claim 1 wherein said multifilament yarns are substantially untwisted throughout the steps of said method.

8. The method of claim 1 wherein said coating composition comprises from about 1 to about 40 percent by weight of said multifilament yarn on a dried basis.

9. The method of claim 1 wherein said coated yarn is drawn to a draw ratio of from about 1.1 to about 10.

10. The method of claim 9 wherein said coated yarn is drawn to a draw ratio of from about 1.1 to about 1.8.

11. The method of claim 10 wherein the temperature in said heating step is from about 90 to about 120° C.

12. The method of claim 9 wherein said coated yarn is drawn to a draw ratio of from about 2 to about 10.

13. The method of claim 12 wherein the temperature in said heating step is from about 135° C. to about 160° C.

14. The method of claim 1 wherein said coated multifilament yarn is heated in a hot air oven.

15. The method of claim 14 wherein the temperature of said oven is from about 90 to about 160° C.

16. The method of claim 1 wherein said colorant comprises a dye or pigment.

17. The method of claim 1 wherein the stretching of the multifilament yarn is at a stretch ratio of from about 3 to about 10 and wherein said multifilament yarn after stretching has a denier of from about 50 to about 10,000 and a tenacity from about 25 to about 80 g/d.

18. The method of claim 1 wherein said coating composition is in the form of a solution, dispersion or emulsion of said colorant and carrier in a solvent.

19. The method of claim 1 wherein said coating step comprises passing said multifilament yarn through a coating bath comprising said coating composition.

20. A method of making a colored color-fast multifilament ultrahigh molecular weight polyolefin yarn, the method comprising the steps of:

feeding a plurality of substantially untwisted multifilament ultrahigh molecular weight polyolefin yarns, each yarn being aligned in a substantially uniaxial direction;

coating the individual filaments of said substantially untwisted, substantially uniaxial aligned multifilament yarns with a coating composition comprising colorant in a thermoplastic resin carrier, wherein said coating composition comprises a solvent; said thermoplastic resin having a lower melting point than the filaments of said multifilament yarns, with said coating composition being adhered to the filaments of said multifilament yarn; and heating the multifilament yarns while stretching the yarn without fusing of the filaments of said multifilament yarn;

whereby a colored color-fast multifilament yarn that retains its multifilament characteristics is formed, wherein adjacent filaments are not fused together either partially or fully, and having individual filaments colored by said colorant with the color becoming an integral part of said filaments of said multifilament yarn.

21. A method of making a colored article, said method comprising the steps of:

feeding at least one substantially untwisted multifilament ultrahigh molecular weight polyolefin yarn, each yarn being aligned in a substantially uniaxial direction;

coating the individual filaments of said substantially untwisted, substantially uniaxial aligned multifilament yarn with a coating composition comprising colorant in a thermoplastic resin carrier, wherein said coating composition comprises a solvent; said thermoplastic resin having a lower melting point than the filaments of said multifilament yarn, with said coating composition being adhered to the filaments of said multifilament yarn;

heating the multifilament yarn while stretching the yarn without fusing of the filaments of the multifilament yarn to thereby form a colored color-fast multifilament yarn that retains its multifilament characteristics wherein adjacent filaments are not fused together either partially or fully, and having individual filaments colored by said colorant with the color becoming an integral part of said filaments of said multifilament yarn;

forming an article from said colored color-fast multifilament yarn; and heating said article whereby said thermoplastic resin is at least softened so as to form a colored surface coating on said article.

22. The method of claim 21 wherein said article comprises a rope.

23. The method of claim 21 wherein said article comprises a woven fabric.

24. The method of claim 21 wherein said article comprises a fishing line.

* * * * *